US007788759B2

(12) United States Patent
Yang et al.

(10) Patent No.: US 7,788,759 B2
(45) Date of Patent: Sep. 7, 2010

(54) STANDING DUSTER ARTICLE

(76) Inventors: Ya Ching Yang, 8F-1, 12, Sec. 2 Cheng Teh Rd., 103 Taipei (TW); Yi-Jun Pan, 8F-1, 12, Sec. 2 Cheng Teh Rd., 103 Taipei (TW)

( * ) Notice: Subject to any disclaimer, the term of this patent is extended or adjusted under 35 U.S.C. 154(b) by 1097 days.

(21) Appl. No.: 11/387,834

(22) Filed: Mar. 24, 2006

(65) Prior Publication Data

US 2007/0033761 A1 Feb. 15, 2007

(30) Foreign Application Priority Data

Aug. 12, 2005 (TW) ..... 94127652 A

(51) Int. Cl.
*A47L 13/10* (2006.01)

(52) U.S. Cl. ..... 15/229.3; 15/226

(58) Field of Classification Search ..... 15/226, 15/227, 229.1–229.3, 229.7, 209.1, 115
See application file for complete search history.

(56) References Cited

U.S. PATENT DOCUMENTS 6,813,801 B2 * 11/2004 Tanaka et al. ..... 15/229.3
6,978,509 B2 * 12/2005 Lin ..... 15/229.7
7,251,851 B2 * 8/2007 Lin et al. ..... 15/229.1

* cited by examiner

*Primary Examiner*—Dung Van Nguyen

(57) ABSTRACT

A standing duster article consisting of a dusting portion and a spiral handle, wherein the dusting portion is comprised of a segmented intermingled yarn layer, a hot-meltable nonwoven fabric layer, a smooth nonwoven fabric layer, and a non-woven/woven fabric layer; the segmented intermingled yarn layer is interleaved between the hot-meltable nonwoven fabric layer and the smooth nonwoven fabric layer; the non-woven/woven fabric layer is further superimposed on the smooth nonwoven fabric layer; a hot-pressing process is carried out to fuse the segmented intermingled yarn layer, the hot-meltable nonwoven fabric layer, the smooth nonwoven fabric layer, and the nonwoven/woven fabric layer; the resulted lamination after fusion is cut by a cutting apparatus, so as to generate a slit in the middle to form the dusting portion which is easy to be folded to form two elongated openings; and a spiral end of the spiral handle is inserted into the openings to form the duster article with the spiral dusting portion. Since the intermingled yarn of the segmented intermingled yarn layer used in the present invention comprises alternate loose and tight segments, the fibers on the loose segments of the intermingled yarn are capable of capturing more dust powder. The alternate loose and tight segments are formed by twisting the intermingled yarn, such that each of the bundles of the intermingled yarn is effectively bound and will not tangle with each other. Further, it is easy to install or remove the spiral handle in or from the dusting portion by such design.

7 Claims, 4 Drawing Sheets

STANDING DUSTER ARTICLE

BACKGROUND

1. Technical Field

The present invention relates to a standing duster article, in particular a duster article structure comprising a plurality of nonwoven fabric layers and fibers, wherein the nonwoven fabric layers undergo hot-pressing and cutting, so as to generate a slit in the middle to receive the spiral handle, thereby forming a dusting surface with multi-layers and better dusting effect.

2. Prior Art

There are various dusting tools on the market, from simple dust cloth to all kinds of dust mops. These dusting tools posses dusting function, however, the effect is not remarkable and thus results in the following shortcomings:

1. Since dust particles are tiny, the effect of the dust cloth and the dust mops is not satisfying and it usually requires repetition of wiping to obtain better effect. Moreover, the dust particles remaining on the dust cloth tend to scratch the articles to be cleaned.
2. The front end of the conventional dust mops cannot be replaced. As a result, after a long-term use or the dusting portion at the front end gets dirty, the dust mops have to be discarded even if the dust only clings to their surfaces. It is not environmental friendly nor cost-effective.
3. The users have to directly touch the dust cloth while using it, dust and bacteria thus are prone to stick to the users' skin and further do harm to the users' health.
4. The conventional dust cloth or dust mops require horizontal movement, which is likely to raise the dust and make the users breathe in the dust, further bringing harm to their lungs. The raised dust also tends to scratch the articles to be cleaned.

With reference to U.S. Pat. No. 6,813,801, entitled "Cleaning Article", a similar cleaning article including a brush portion has been disclosed. The cleaning article comprises two sheets, at least one of which has a plurality of strips; and two layers of a fiber bundle, wherein said two sheets are overlaid in a face-to-face relationship with each other at two joining portions, defining a holding space between confronting faces of said two sheets, and said two fiber bundle layers are disposed on cleaning faces of said two sheets opposite from said confronting faces and joined to said two sheets at said two joining portions.

This prior art further includes a cleaning article having a brush portion for collecting dust, comprising a base sheet; a fiber bundle layer of filaments disposed on a cleaning-face of said base sheet, the individual filaments extending in one direction to traverse said whole fiber bundle layer; and a cleaning-side sheet disposed on a cleaning-face of said fiber bundle layer, said cleaning-side sheet being cut from opposing edges to have a plurality of strips oriented in the same direction as the filaments, said fiber bundle layer and said cleaning-side sheet being joined to said base sheet along a longitudinal centerline of the article so that said strips and said filaments have free ends on each side of said longitudinal centerline to thereby provide brush portions, wherein a holding space, into which a hand of a user or a holder is to be inserted, is formed between said base sheet and a holding sheet disposed on a face of said base sheet opposite from the cleaning-face, said holding space being located above said fiber bundle layer and said cleaning-side sheet in a thickness direction of the article.

The term "fiber bundle" in this prior art refers to a bundle of a number of fibers. Examples of the fibers include filaments, flat yarns, split yarns and the like, wherein examples of the fibers include: fibers of PE (polyethylene), PP (polypropylene) or PET (polyethylene terephthalate); and conjugated fibers of PE/PET or PE/PP (e.g., conjugated fibers of a core/sheath structure having a core of PP or PET and a sheath of PE). The fibers forming the fiber bundle layer of the prior art are crimped. With the fibers being crimped, the fiber bundle layer becomes so bulky as to take a structure enabled to capture dust easily by the crimped portions. Especially preferred are crimped filaments opened from a tow.

However, in order to prevent the fibers from being so overcrimped that they become too bulky to be used, a plurality of strips are further adopted to overlay the fibers of the fiber bundle layer, so as to keep the fiber bundles from intertwining caused by friction over a large area.

Although the prior art specifies that the fibers are not limited to be a single filament, it does disclose any other embodiments thereof. Hence upon the research made by the inventor, it is found that an intermingled yarn with segmented structure comprising alternate loose and tight segments is capable of capturing more dust powder with the fibers on the loose segments. Moreover, since the alternate loose and tight segments are formed by twisting the intermingled yarn, each of the bundles of the intermingled yarn is effectively bound and will not tangle with each other, thereby prohibiting the problems of fiber tangle and shortage of fiber capacity in the prior art. In addition, since the fiber bundle layer used in the prior art is too fluffy, it requires a plurality of strips to gather the fiber bundles in the center portion of the cleaning article, which increases the cost of material. Compared with the prior art, the directions of the fiber bundles of the present invention can be confined merely by relatively short border strips, thereby dramatically increasing the contact area between the fiber bundle layer possessing higher cleaning capability and the article to be cleaned. Also, the fiber bundle layer is softer than the strips, the possibility of scratching the articles to be cleaned thus can be reduced. Further, the present invention discloses a spiral handle to be used in combination, which forms a cleaning surface with multi-layer structure that possesses higher dusting capability.

Moreover, the applicant of this application also proposes a spiral duster in an application entitled "Spiral Duster", wherein the duster comprises a handle with a crooked pole extending from the front end of the handle; a groove is disposed on each of the two lateral sides of the crooked pole, and a post is disposed under each of the lateral sides; an elbow tenon is disposed at the front end of the crooked pole; the elbow tenon comprises an arc housing, wherein a streamlined slot is disposed in the arc housing along the crooked pole, a rib is disposed on each of the two lateral sides of the slot, and a via hole is disposed under each of the two lateral sides, such that when operated by an user, the via holes of the arc housing engage with the posts of the crooked pole to form a bend point, and the two ribs of the arc housing engage with the grooves of the crooked pole, thereby the handle is integrally coupled with a spiral batten, and the spiral batten is further sheathed into an opening of an accommodating pocket, such that the dust sheet wraps the spiral batten and forms a spiral duster accordingly. However, since the crooked pole of the handle usually blocks the carrying out of the cleaning due to its bend angle, improvement is still required.

In view of the aforementioned problems present in the conventional cleaning articles, the applicant of this application concerns innovation and improvement thereof, and after long-term research, the standing duster article of the present invention is finally obtained.

SUMMARY OF THE INVENTION

An aspect of the present invention is to provide a standing duster article capable of reducing the raise of dust, wherein the fiber bundles are not likely to be tangled and the duster portion is gathered onward. The standing duster article comprises a plurality of nonwoven fabric layers and fibers undergoing hot-pressing and cutting to generate a slit in the middle, which are used in conjugation with a spiral handle. Since the nonwoven fabric layer is always shorter than the segmented intermingled yarn layer, an excellent dusting effect can be obtained by combining the nonwoven fabric layers with the segmented intermingled yarn layer that is always longer than the nonwoven fabric layers. Since the intermingled yarn of the segmented intermingled yarn layer used in the present invention comprises alternate loose and tight segments, the fibers on the loose segments of the intermingled yarn are capable of capturing more dust powder. The alternate loose and tight segments are formed by twisting the intermingled yarn, such that each of the bundles of the intermingled yarn is effectively bound and will not tangle with each other.

A further aspect of the present invention is to provide a standing duster article consisting of the dusting portion and the spiral handle in conjugation, such that only the dusting portion has to be replaced after getting dirty or damaged due to a long-term use, thereby decreasing the cost of replacement. As shown, the protruding portions of the spiral handle of this invention are intentionally narrowed, such that the whole handle can be freely used at any angle while cleaning.

A still further aspect of this invention is to provide a standing duster article with simple structure, which is easy-to-handle, durable, and environmental friendly etc.

The standing duster article of the present invention consists of a dusting portion and a spiral handle, wherein the dusting portion is comprised of a segmented intermingled yarn layer, a hot-meltable nonwoven fabric layer, a smooth nonwoven fabric layer, and a nonwoven/woven fabric layer; the segmented intermingled yarn layer is interleaved between the hot-meltable nonwoven fabric layer and the smooth nonwoven fabric layer; the nonwoven/woven fabric layer is further superimposed on the smooth nonwoven fabric layer; a hot-pressing process is carried out to fuse the segmented intermingled yarn layer, the hot-meltable nonwoven fabric layer, the smooth nonwoven fabric layer, and the nonwoven/woven fabric layer; the resulted lamination after fusion is cut by a cutting apparatus, so as to generate a slit in the middle to form the dusting portion which is easy to be folded to form two elongated openings; two elongated ends of the spiral handle are further inserted into the two elongated openings of the dusting portion, thereby forming a duster article.

DETAILED DESCRIPTION OF THE INVENTION

Figure 1A:
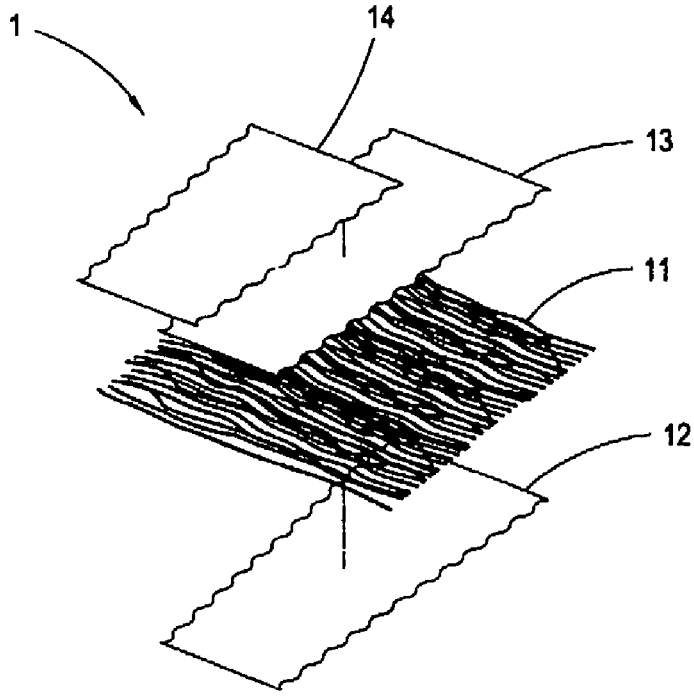
FIG. 1A is an exploded view of the dusting portion of the standing duster article according to the first embodiment of the present invention.
Figure 1B:
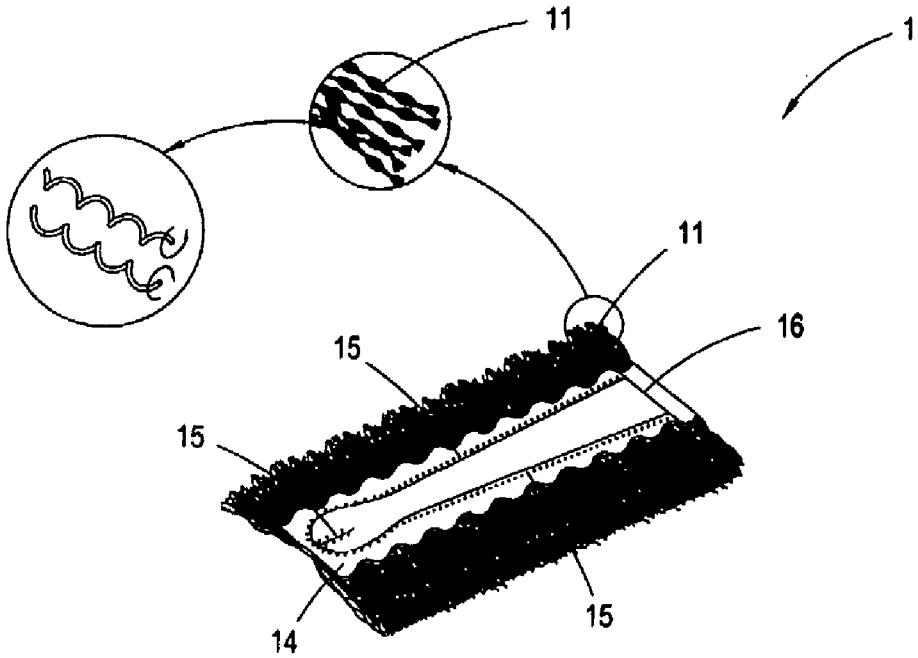
FIG. 1B is an illustrative view along with an enlarged view of the dusting portion of the standing duster article according to the first embodiment of the present invention.
Figure 2:
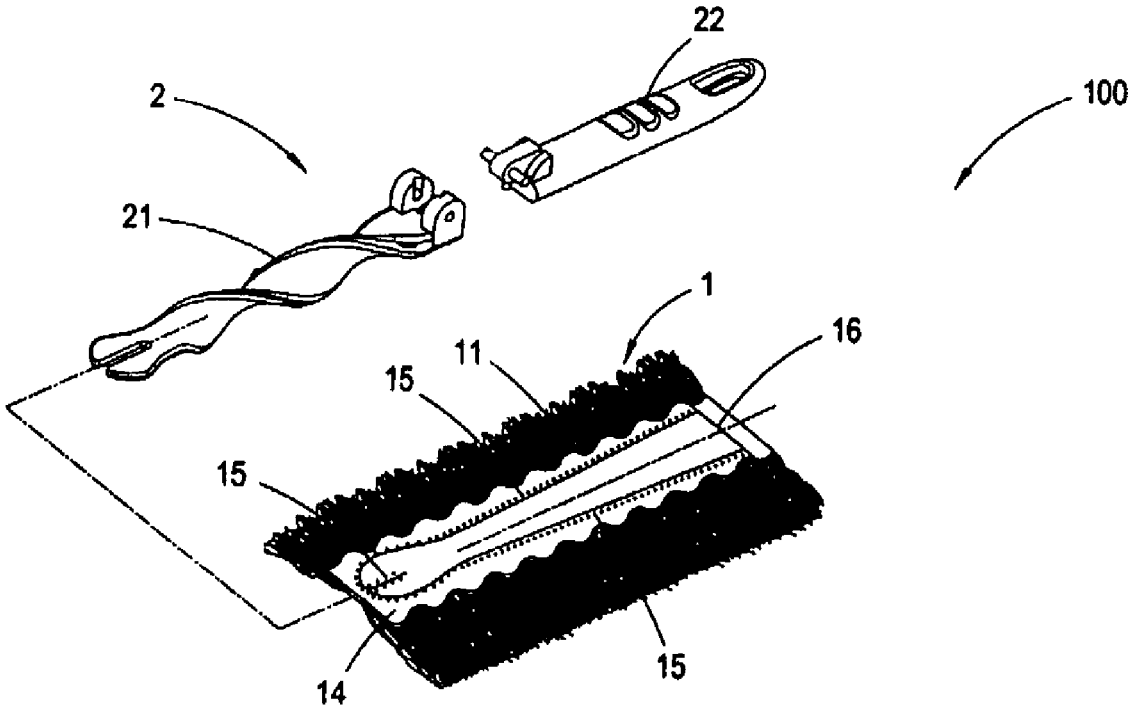
FIG. 2 is an exploded view of the dusting portion and the spiral handle of the standing duster article according to the first embodiment of the present invention.
Figure 3:
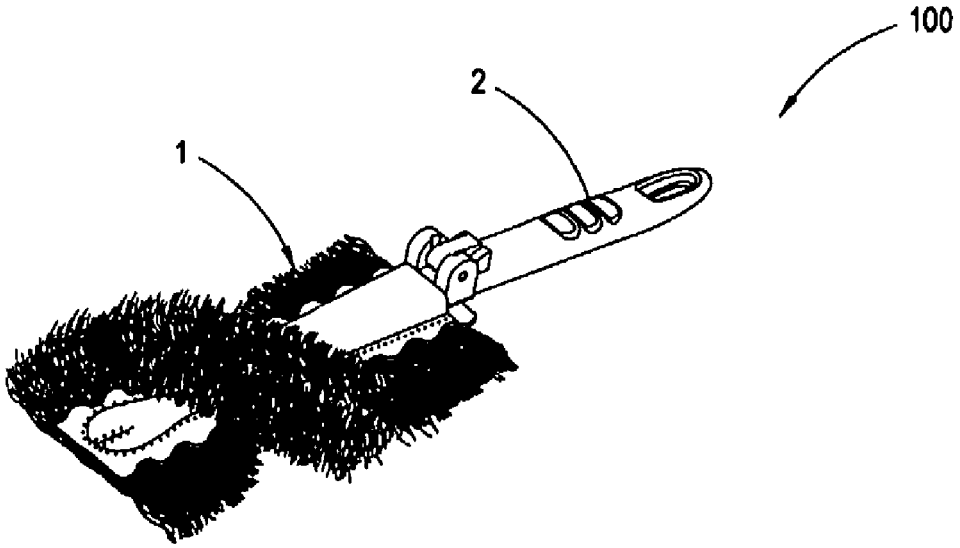
FIG. 3 is a schematic view of the dusting portion in conjugation with the spiral handle of the standing duster article according to the first embodiment of the present invention.

Please refer to FIGS. 1A to 3, wherein FIG. 1A is an exploded view of the dusting portion of the standing duster article according to the first embodiment of the present invention; FIG. 11B is an illustrative view together with an enlarged view of the dusting portion of the standing duster article according to the first embodiment of the present invention; FIG. 2 is an exploded view of the dusting portion and the spiral handle of the standing duster article according to the first embodiment of the present invention; and FIG. 3 is a schematic view of the dusting portion in conjugation with the spiral handle of the standing duster article according to the first embodiment of the present invention. According to the figures, it can be know that the duster article of the present invention consists of a dusting portion 1 and a spiral handle 2, wherein the dusting portion 1 comprises: a hot-meltable nonwoven fabric layer 12; a segmented intermingled yarn layer 11 disposed on the hot-meltable nonwoven fabric layer 12, the intermingled yarn of the segmented intermingled yarn layer 11 comprises alternate loose and tight segments, such that the fibers on the loose segments are capable of capturing more dust powder; a smooth nonwoven fabric layer 13 disposed on the segmented intermingled yarn layer 11, such that the segmented intermingled yarn layer 11 is sandwiched between the hot-meltable nonwoven fabric layer 12 and the smooth nonwoven fabric layer; a nonwoven/woven fabric layer 14 disposed on the smooth nonwoven fabric layer 13; a hot-pressing process is then performed on the lamination formed with the hot-meltable nonwoven fabric layer 12, the segmented intermingled yarn layer 11, the smooth nonwoven fabric layer 13, and the nonwoven/woven fabric layer 14 in this order to fuse the hot-meltable nonwoven fabric layer 12, the segmented intermingled yarn layer 11, the smooth nonwoven fabric layer 13, and the nonwoven/woven fabric layer 14. The resulted lamination after fusion comprises three fusion lines 15, wherein the fusion line 15 in the middle is always shorter than the fusion lines 15 on the lateral sides, and a closed shape is formed at the front ends of the fusion lines while an elongated opening 16 is formed at the rear end. The elongated opening 16 is configured to receive a spiral end 21 of the spiral handle 2, further forming a spiral duster article 100. With such design, it is easy to install or remove the spiral handle 2 in or from the dusting portion 1. In addition, the aforementioned spiral handle 2 is composed of the spiral end 21 and a holding portion 22 engaged with each other.

Figure 4:
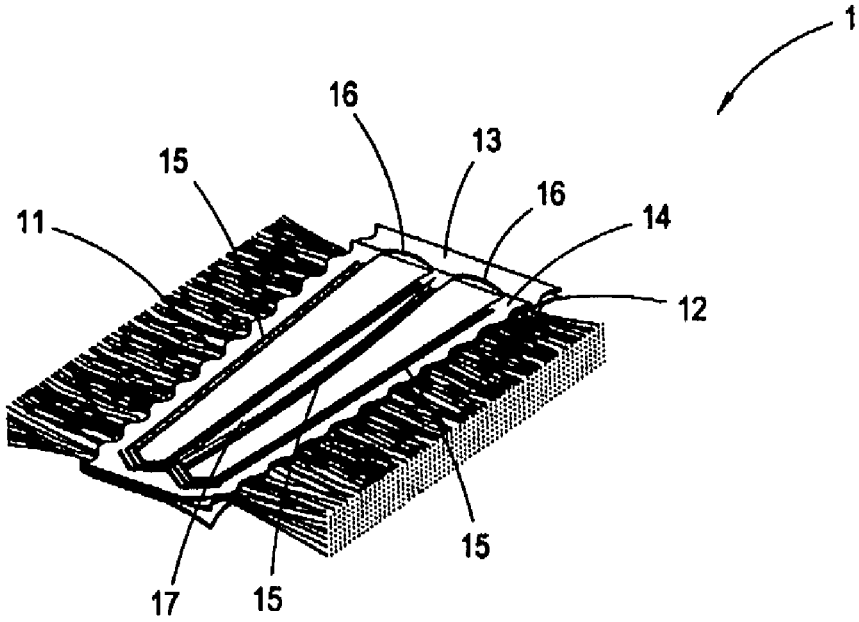
FIG. 4 is an illustrative view of the dusting portion of the standing duster article according to the second embodiment of the present invention.
Figure 5:
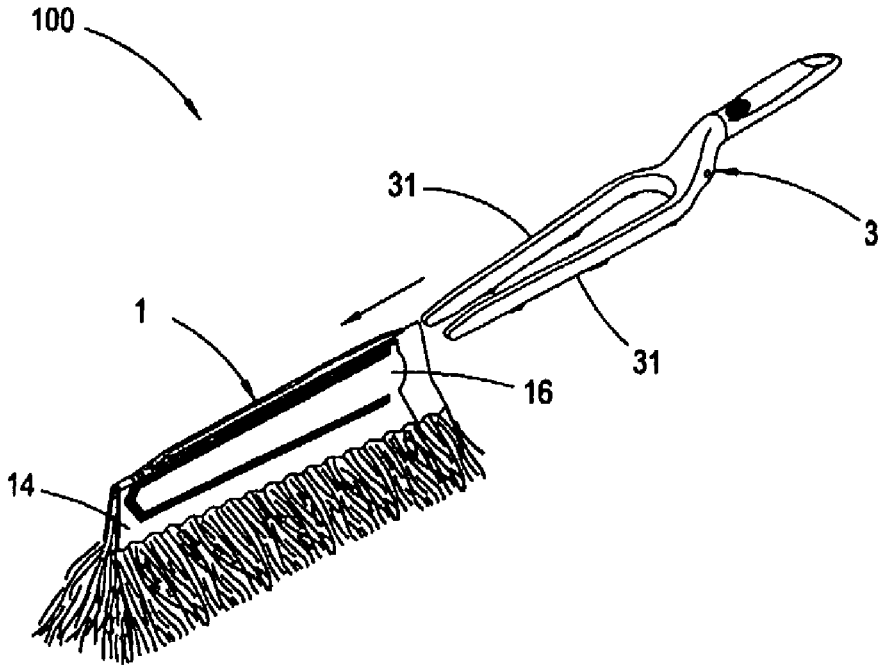
FIG. 5 is an exploded view of the dusting portion and the bifurcated handle of the standing duster article according to the second embodiment of the present invention.
Figure 6:
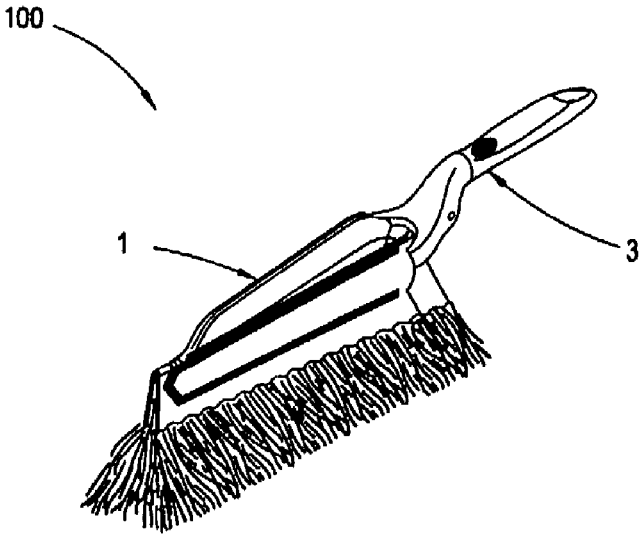
FIG. 6 is a schematic view of the of the dusting portion in conjugation with the bifurcated handle of the standing duster article according to the second embodiment of the present invention.

Please refer to FIGS. 4 to 6, wherein FIG. 4 is an illustrative view of the dusting portion of the standing duster article according to the second embodiment of the present invention; FIG. 5 is an exploded view of the dusting portion and the bifurcated handle of the standing duster article according to the second embodiment of the present invention; and FIG. 6 is a schematic view of the of the dusting portion in conjugation with the bifurcated handle of the standing duster article according to the second embodiment of the present invention. According to the figures, it can be know that the duster article of the present invention consists of a dusting portion 1 and a bifurcated handle 3, wherein the dusting portion 1 comprises: a hot-meltable nonwoven fabric layer 12; a segmented intermingled yarn layer 11 disposed on the hot-meltable nonwoven fabric layer 12, the intermingled yarn of the segmented intermingled yarn layer 11 comprises alternate loose and tight segments, such that the fibers on the loose segments are capable of capturing more dust powder; a smooth nonwoven fabric layer 13 disposed on the segmented intermingled yarn layer 11, such that the segmented intermingled yarn layer 11 is sandwiched between the hot-meltable nonwoven fabric layer 12 and the smooth nonwoven fabric layer; a nonwoven/woven fabric layer 14 disposed on the smooth nonwoven fabric layer 13; a hot-pressing process is then performed on the lamination formed with the hot-meltable nonwoven fabric layer 12, the segmented intermingled yarn layer 11, the smooth nonwoven fabric layer 13, and the nonwoven/woven fabric layer 14 in this order to fuse the hot-meltable nonwoven fabric layer 12, the segmented intermingled yarn layer 11, the smooth nonwoven fabric layer 13, and the nonwoven/woven fabric layer 14. The resulted lamination after fusion comprises at least three fusion lines 15, wherein the width of the fusion line 15 in the middle is always wider than that of the fusion lines 15 on the lateral sides, or the amount of the fusion lines 15 in the middle is always more than that of the fusion lines 15 on the lateral sides. The fusion line 15 in the middle is further cut by a cutting apparatus, such that a slit 17 is generated in the center of the fusion line 15 in the middle. The generated slit 17 enables the dusting portion 1 to be folded easily, and the fusion lines 15*b* forms two elongated openings 16 for receiving two elongated ends 31 of a bifurcated handle 3, thereby a duster article 100 is further generated. With such design, it is easy to install or remove the bifurcated handle 3 in or from the dusting portion 1.

Figure 7:
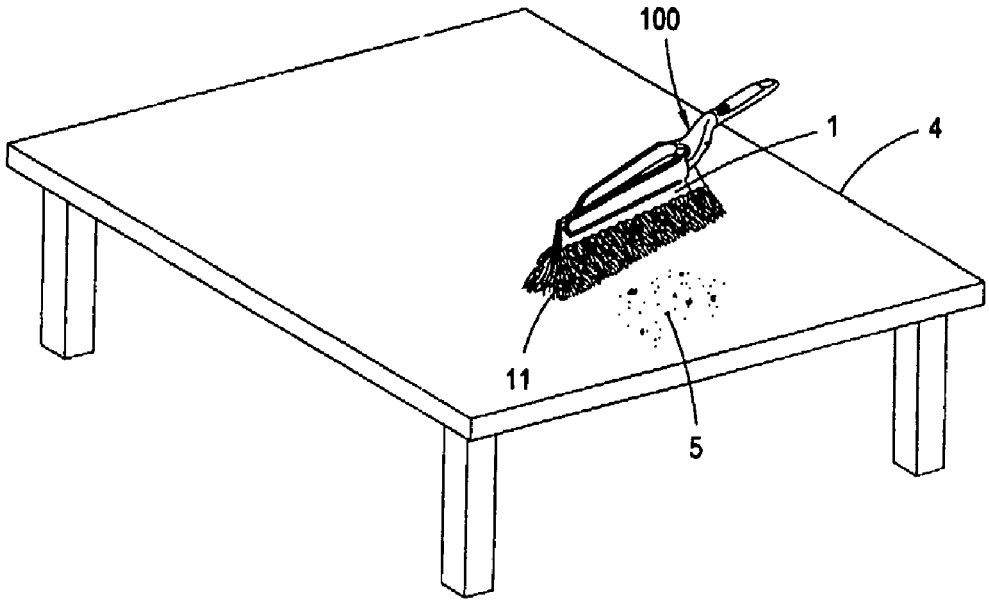
FIG. 7 is a schematic view of the standing duster article.

With reference to FIG. 7, which shows a schematic view of the standing duster article, it can be known that the duster article 100 of the present invention comprises the exposed segmented intermingled yarn layer 11 on the dusting portion 1, which can be used to clean dust 5 on a table 4 and involves excellent cleaning effect.

In order to emphasize the inventive step and practicability of the present invention, a comparison between the present invention and the prior art is provided below:

SHORTCOMINGS OF THE PRIOR ART

1. Since dust particles are tiny, the effect of the dust cloth and the dust mops that adopts a plurality of nonwoven fabric strips is not satisfying and it usually requires repetition of wiping to obtain better effect. Moreover, the dust particles remaining on the dust cloth tend to scratch the articles to be cleaned.
2. The strips of the conventional dust mops are coarse and the filaments of the conventional dust mops are too soft that they tend to get tangled. As a result, the strips get dirty easily and the filaments get tangled easily too. It is also difficult to reach and clean the inside. Therefore, it is not environmental friendly nor cost-effective.
3. The users have to directly touch the dust cloth while using it, dust and bacteria thus are prone to stick to the users' skin and further do harm to the users' health.
4. The conventional dust cloth or dust mops are required to be used horizontally, which may suppresses the dust particles between the dust cloth or dust mops and the article to be cleaned and tends to scratch the articles to be cleaned. The dust particles cannot be removed immediately either.

ADVANTAGES OF THE PRESENT INVENTION

1. The standing duster article of the present invention comprises a plurality of nonwoven fabric layers and fibers undergoing hot-pressing and cutting to generate a slit in the middle, which are used in conjugation with a spiral handle. Since the nonwoven fabric layers are always shorter than the segmented intermingled yarn layer, an excellent dusting effect can be obtained by combining the nonwoven fabric layers with the segmented intermingled yarn layer that includes tangle-proof intermingled yarn.
2. The intermingled yarn of the segmented intermingled yarn layer of the standing duster article of the present invention comprises alternate loose and tight segments, thereby the fibers on the loose segments of the intermingled yarn are capable of capturing more dust powder. The alternate loose and tight segments are formed by twisting the intermingled yarn, such that each of the bundles of the intermingled yarn is effectively bound and will not tangle with each other.
3. The standing duster article of the present invention consists of the dusting portion and the spiral handle in conjugation, such that only the dusting portion has to be replaced after getting dirty or damaged due to a long-term use, thereby decreasing the cost of replacement.
4. The standing duster article of the present invention involve the advantages of structure simplicity, manipulation easiness, long lifetime, and environmental friendliness etc.
5. The users' hands will not directly touch the dust and the dust is not likely to be raised while using the standing duster article of the present invention, the users' health thus can be protected.
6. The standing duster article of the present invention comprises the segmented intermingled yarn layer which is always longer than the nonwoven fabric layers and the intermingled yarn thereof is always vertical, such that the intermingled yarn with the best dusting effect directly contacts the article to perform wiping, thereby preventing the coarse nonwoven fabric layers from contacting or scratching the article o be wiped.

The above detailed description is to exemplify the present invention with some embodiments, not to limit the scope of the present invention. It will be apparent to those skilled in the art that various changes and modification may be made without departing from the spirit and scope of the invention as defined in the following claims.

To sum up, this application not only involves innovation in techniques, also includes improvement on the effects of the conventional articles, which should sufficiently meet the invention patent requirements of novelty and inventive step. Therefore, this application is proposed based on law. It is respectfully requested that the present invention to be granted a patent, so as to encourage invention.

REFERENCE NUMERAL LIST

100 duster article
1 dusting portion
11 segmented intermingled yarn layer
12 hot-meltable nonwoven fabric layer
13 smooth nonwoven fabric layer
14 nonwoven/woven fabric layer
15 fusion line
151 middle

16 elongated opening
17 slit
2 spiral handle
21 spiral end
22 holding portion
3 bifurcated handle
31 elongated end
4 table
5 dust What claimed is:

1. A standing duster article consisting of a dusting portion and a spiral handle, wherein the dusting portion comprises:

a hot-meltable nonwoven fabric layer;

a segmented intermingled yarn layer disposed on the hot-meltable nonwoven fabric layer;

a smooth nonwoven fabric layer disposed on the segmented intermingled yarn layer;

a nonwoven/woven fabric layer disposed on the smooth nonwoven fabric layer; and a space formed between the nonwoven/woven fabric layer and the smooth nonwoven fabric layer for receiving the spiral handle, wherein two elongated ends of the spiral handle are inserted into two elongated openings of the space, thereby forming the duster article, which is characterized in that:

a length of the segmented intermingled yarn layer is longer than those of hot-meltable nonwoven fabric layer and the smooth nonwoven fabric layer; otherwise, a length of the nonwoven/woven fabric layer is shorter than that of the segmented intermingled yarn layer, such that a contact area between the segmented intermingled yarn layer and an article to be cleaned is increased and dusting effect is enhanced and the standing shape of the segmented intermingled yarn layer is secured thereby.

2. The standing duster article according to claim 1, wherein intermingled yarn of the segmented intermingled yarn layer is formed by twisting two bundles of filaments twisted in different directions, such that twisting forces of the two bundles of filaments are neutralized to prevent tangle of the intermingled yarn.

3. The standing duster article according to claim 1, wherein the hot-meltable nonwoven fabric layer and the smooth nonwoven fabric layer are cut to have wavy or linear edges around outer fusion lines, so as to effectively control directions of the intermingled yarn without blocking the contact area between the segmented intermingled yarn layer and an article to be cleaned, thereby realizing standing dusting effect.

4. The standing duster article according to claim 1, wherein a hot-pressing process is carried out to fuse a lamination formed with the hot-meltable nonwoven fabric layer, the segmented intermingled yarn layer, the smooth nonwoven fabric layer, and the nonwoven/woven fabric layer in this order; the resulted lamination after fusion comprises at least three fusion lines, wherein a width of the fusion lines in the middle is always wider than that of the fusion lines on the lateral sides, or an amount of the fusion lines in the middle is always more than that of the fusion lines on the lateral sides.

5. The standing duster article according to claim 1, wherein the space for receiving the spiral handle includes two spaces formed at front ends of a plurality of fusion lines which include a fusion line in the middle shorter than fusion lines on two lateral sides, thereby forming the space for receiving a front end of the spiral handle.

6. The standing duster article according to claim 1, wherein the space for receiving the spiral handle is formed with a slit generated in the center of the fusion line in the middle by a cutting apparatus, thereby forming a space for receiving a bifurcated handle and further forming a standing duster of another type.

7. The standing duster article according to claim 1, wherein the spiral handle is a bifurcated handle, and the segmented intermingled yarn layer comprises at least a part of fiber bundles.

* * * * *